United States Patent [19]

Porter et al.

[11] Patent Number: 4,662,140

[45] Date of Patent: May 5, 1987

[54] BRICK SUPPORT STRUCTURE

[75] Inventors: William H. Porter, Saugatuck, Mich.; Ronald B. Lossé, 7855 Ronson, Jenison, Mich. 49428

[73] Assignee: Ronald B. Lossé, Jenison, Mich.

[21] Appl. No.: 781,793

[22] Filed: Sep. 30, 1985

[51] Int. Cl.[4] ..... E04F 13/08

[52] U.S. Cl. ..... 52/385; 52/387

[58] Field of Search ..... 52/384, 385, 386, 387, 52/391, 392, 404

[56] References Cited

U.S. PATENT DOCUMENTS

| | | | |
|---|---|---|---|
| 800,655 | 10/1905 | Kitsee . | |
| 830,313 | 9/1906 | Fenn . | |
| 874,909 | 12/1907 | Fischer . | |
| 1,850,961 | 3/1932 | Mortenson | 52/387 |
| 1,861,359 | 5/1932 | Pyron . | |
| 1,946,690 | 2/1934 | Haines . | |
| 1,994,644 | 3/1935 | Harshberger . | |
| 2,005,380 | 6/1935 | Marsh | 52/392 |
| 2,043,706 | 6/1936 | Myers . | |
| 2,054,573 | 9/1936 | Mendenhall | 52/385 |
| 2,202,568 | 5/1940 | Worden | 52/387 |
| 3,270,473 | 9/1966 | Smith | 52/390 |
| 3,387,422 | 6/1968 | Wanzer | 52/387 |
| 3,387,422 | 6/1968 | Wanzer . | |
| 3,533,206 | 10/1970 | Passewo | 52/387 |
| 3,533,206 | 10/1970 | Passeno, Jr. . | |
| 3,740,911 | 6/1973 | O'Leary . | |
| 3,962,504 | 6/1976 | Sherwin | 52/390 |

*Primary Examiner*—John E. Murtagh

*Attorney, Agent, or Firm*—Emrich & Dithmar

[57] ABSTRACT

A masonry/brick support structure is adapted for secure positioning upon a substructure such as a wall and includes a sheet metal underlayer or panel having a plurality of tabs punched therein and extending outward from a first side thereof. Also positioned on the first side of the sheet metal panel are adhesive strips for permanently affixing bricks to the panel's first, or outer, side with the bricks positioned in a given spaced array on the panel by the tabs extending therefrom. The tabs may be incorporated in the sheet metal panel in virtually any array to allow for a wide range of brick shapes and dimensions as well as various brick alignment arrangements. The tabs provide support for the bricks when initially positioned upon the panel. Mortar or grout is positioned in the inter-brick spaces and over the tabs which are thus no longer visible. The first, outer surface of the sheet metal panel may also be provided with an appropriate adhesive layer for maintaining the mortar or grout applied thereto securely in position after it sets. The sheet metal panel may be provided on a second, inner surface thereof with an insulating layer such as a foam insulation which is maintained thereon by an appropriate adhesive layer to form an insulated building structure.

9 Claims, 3 Drawing Figures

BRICK SUPPORT STRUCTURE

BACKGROUND OF THE INVENTION

This invention relates generally to building materials and structures and is particularly directed to a wall covering for supporting and maintaining in position a masonary or brick surface thereon.

In building construction, it has become common to provide a wall with a thin brick surface for improved appearance and enhanced durability. These face brick structures typically include a sheet metal lath which is mounted to the wall to be covered and on an outer surface of which is positioned an array of thin bricks, masonry elements or tiles. The manner in which the thin bricks are affixed to the outer surface of the sheet metal panel should provide secure mounting of the thin bricks thereon for years of use, while facilitating the placement and positioning of the individual brick or masonry elements to allow this form of construction to be economically competitive. Moreover, the sheet metal panel should be inexpensive and should allow flexibility in the variety of brick arrays and configurations positioned thereon. The brick support arrangement should also be readily adapted for new construction as well as retrofitting on existing structures. Finally, the brick support arrangement should provide an insulating, structural facing and offer a fire resistance capability in combination on with the enhanced durability and aesthetics of a brick facade. To date, no brick support arrangement has been able to provide all of the aforementioned features.

The present invention is intended to provide a brick support structure which is of low cost, easily installed, offers virtually unlimited flexibility in the positioning patterns of bricks and masonry elements thereon, and is particularly adapted for covering irregularly configured and contoured surfaces.

OBJECTS AND SUMMARY OF THE INVENTION

Accordingly, it is an object of the present invention to provide an improved arrangement for the positioning of masonry elements, bricks, or tiles on a wall.

It is another object of the present invention to provide an outer wall covering which affords a high degree of insulation as well as an attractive brick, masonry or tile veneer.

Still another object of the present invention is to provide an inexpensive, easily installed and highly weather-resistant outer wall covering which may be used in new construction as well as retrofitted on existing structures.

A further object of the present invention is to provide an improved arrangement for the placing of a brick facade on a flat structural member such as a wall.

A still further object of the present invention is to provide a wall covering having the strength and durability of a reinforced concrete structure, the insulating characteristics of an expanded foam or fiberglass insulator, and the attractiveness of brick, masonry or tile.

Yet another object of the present invention is to provide an improved structure for re-covering an old wall without removing its original surface or requiring any modification thereof.

The present invention contemplates a brick, masonry or tile support structure including a sheet metal panel having a plurality of punched-out tabs therein. The tabs are arranged in spaced, generally horizontal linear arrays to facilitate the positioning thereon of uniformly shaped masonry elements such as thin bricks. Also positioned upon the front surface of the sheet metal panel between adjacent horizontal arrays of punched-out tabs are linear strips of a fixing material such as an epoxy cement for securing the bricks to the flat panel. The bricks are initially maintained in position by the punched-out supporting tabs, with the fixing material providing for the permanent attachment of the bricks after it sets. The tabs are easily removed from the front surface of the sheet metal panel such as by hammering or bending them back into the sheet metal panel to allow for the mounting of virtually any arrangement of bricks or masonry elements of virtually any shape thereon. With the bricks positioned upon the sheet metal panel, grout or mortar is inserted in between the bricks, with the panel's front surface provided with an adhesive layer for bonding of the mortar thereto.

The aft surface of the sheet metal panel is also provided with an adhesive layer for securely positioning a layer of insulation such as an expanded foam plastic or fiberglass batting thereon. The sheet metal panel may be shaped so as to include a fin edge portion to facilitate attaching the brick support structure to new construction or overlaying it upon an existing structure. The present invention thus provides the compressive strength of masonry and the tensile strength of steel in a single wall covering which affords a high degree of insulation and the wear and aesthetic qualities of masonry or brick.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
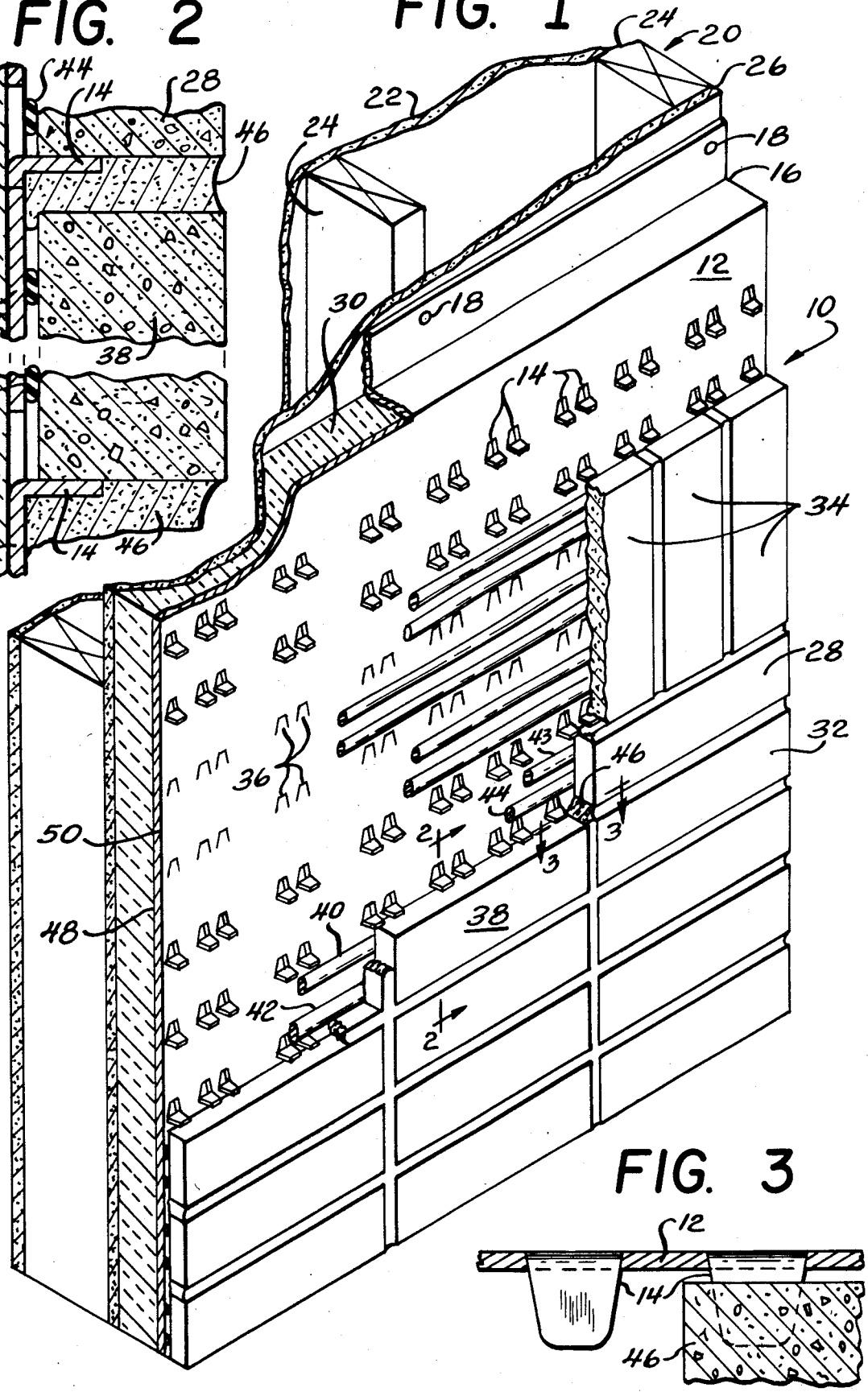
FIG. 1 is a partially cutaway, front perspective view of a brick support structure positioned upon and mounted to a wall in accordance with the present invention.

Referring to FIG. 1, there is shown a partially cutaway perspective view of a brick support structure 10 in accordance with the present invention. The support structure shown in FIG. 1 is adapted for supporting and positioning either a plurality of bricks, masonry elements or tiles upon an underlying support structure, or substructure, such as a wall 20.

Figure 2:
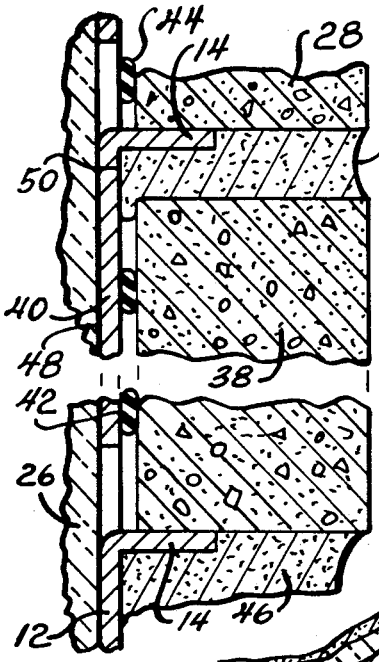
FIG. 2 is a sectional view of the brick support structure of FIG. 1 taken along sight line 2—2 therein.
Figure 3:
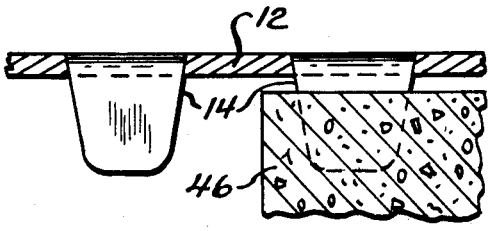
FIG. 3 is a sectional view of the brick support structure of FIG. 1 taken along sight line 3—3 therein.

The brick support structure 10 includes a generally planar, thin sheet metal panel, or backing, 12 which is flexible and thus may be positioned upon either a curvilinear portion or a corner portion of a building structure. The sheet metal 12 includes a plurality of punched-out tabs 14 which extend from an outer surface of the panel. FIGS. 2 and 3, which are sectional views of the brick support structure 10 shown in FIG. 1 taken respectively along sight lines 2—2 and 3—3 therein, respectively illustrate side and top views of the punched-out tabs 14 extending outward from the sheet metal panel 12. The tabs 14 may be incorporated in the sheet metal panel 12 by conventional stamping means (not shown) and are preferably positioned in the sheet metal panel in a predetermined array in accordance with the dimensions and shapes of the bricks or masonry elements to be affixed to the outer surface of the sheet metal panel. As shown in FIG. 1, the punched-out tabs 14 are arranged in pairs in linear, generally horizontal arrays so as to be positioned between immediately adjacent upper and lower bricks. This is specifically shown in FIGS. 1 and 2 wherein the punched-out tab 14 is positioned between an upper brick 28 and a lower brick 38 and provides support for the former as it is positioned upon the sheet metal panel 12.

As shown in FIG. 1, the lower bricks positioned upon the outer surface of the sheet metal panel 12 are aligned generally horizontally, while each of the bricks 34 in the upper row positioned thereon are oriented generally vertically. In order to accommodate the vertically aligned bricks 34 on a sheet metal panel wherein the tabs 14 are punched out in order to accommodate the generally horizontally aligned bricks, those tabs which are positioned beneath the vertically bricks have been pressed back into the sheet metal panel 12 so as to provide an essentially flat, smooth surface immediately beneath the vertically aligned bricks 34. The punched-out tabs 14 may be removed from various portions of the sheet metal panel 12 by conventional means such as by hammering each tab back into the sheet metal panel in providing the panel with a smooth surface at predetermined locations thereon. As shown in FIG. 1, the flattened tabs 36 allow the generally vertically oriented bricks 34 to be positioned along the length thereof in tight fitting contact with the outer surface of the sheet metal panel 12.

Positioned between adjacent rows of punched-out tabs 14 on the outer surface of the sheet metal panel 12 are a pair of generally parallel, elongated adhesive strips 40, 42. The adhesive strips 40, 42 are preferably comprised of a viscous adhesive material such as an epoxy cement. With the adhesive strips 40, 42 in position between adjacent rows of punched-out tabs 14 on the outer surface of the sheet metal panel 12, a brick is positioned in contact with the adhesive strips and between adjacent rows of the punched-out tabs so as to be in contact with and supported by the lower row of punched-out tabs. Thus, as shown in FIGS. 1 and 2, horizontally aligned bricks 28 and 38 are respectively supported by immediately adjacent, upper and lower horizontally aligned rows of punched-out tabs 14. As shown in the figures, upper and lower adhesive strips 43, 44 are positioned beneath and in contact with an upper row of horizontally aligned bricks which includes brick 28. Similarly, upper and lower adhesive strips 40, 42 are positioned beneath and in contact with a row of horizontally aligned bricks which includes bricks 32 and 38. Referring to the horizontal row of vertically aligned bricks 34, it can be seen that each brick is positioned in contact with and supported by three pairs of generally horizontally aligned adhesive strips positioned upon the outer surface of the sheet metal panel 12. As thus far shown, each brick is supported by a plurality of adhesive strips although the present invention also contemplates the use of a single adhesive strip for supporting a brick.

With each brick thus positioned in contact with and supported by a respective pair of adhesive strips, a cementitious material such as grout or mortar 46 is inserted between immediately adjacent bricks. In order to provide coupling between the sheet metal panel 12 and the cementitious material 46 positioned thereon, an outer adhesive layer 50 is deposited upon the outer surface of the sheet metal panel 12 prior to application of the cementitious material in the inter-brick spaces thereon. In a preferred embodiment, the cementitious material is comprised of an acrylic mortar for increased strength of bonding with the sheet metal panel 12 as well as to immediately adjacent bricks and for waterproofing of the brick support structure 10.

To the inner surface of the sheet metal panel 12 is applied an inner adhesive layer 48 to which is affixed a layer of insulation 30. In a preferred embodiment, the layer of insulation 30 is comprised of an expanded foam plastic material such as polystyrene which provides an insulating capability for the brick support structure 10 of the present invention. Other common insulating materials in sheet-like form such as fiberglass batting may be affixed to the inner surface of the sheet metal panel 12 by means of the inner adhesive layer 48. The sheet metal panel 12 is then affixed by means of a plurality of mounting pins 18, such as nails or screws, to a wall 20 which includes an outer surface 26, an inner surface 22, and a plurality of studs 24 therebetween. While the brick support structure 10 of the present invention is shown mounted to a generally vertical wall, it is adapted for mounting to virtually any surface in any orientation. The flexibility of the sheet metal panel 12 allows it to be fitted to curved surfaces as well as to be positioned upon corners over a wide range of angular spacings. In order to facilitate mounting of the sheet metal panel 12 on the wall 20, an edge of the sheet metal panel may be provided with an angled portion 16 such as a nail fin as shown in FIG. 1 by means of which the sheet metal panel may be securely attached and mounted to the wall 20. Adjacent brick support structures in accordance with the present invention may be positioned in overlapping, abutting contact with the brick support structure 10 of FIG. 1 in order to provide a sealed and continuous covering for the wall 20 which is insulated, waterproof, strong, durable and attractive.

There has thus been shown a brick support structure which is adapted for positioning on a substructure such as a wall for mounting a brick, masonry, or tile surface thereon. The brick support structure includes a flexible sheet metal panel which may be positioned upon flat, curvilinear or cornered surfaces such as walls, ceilings, etc., and which includes a plurality of punched-out tabs for spacing and supporting bricks positioned thereon. The tabs may be either spaced to receive bricks having a given size and positioning arrangement on the sheet metal panel or the tabs may be easily pressed back into the panel such as by hammering in order to accommodate bricks of virtually any dimensions as well as virtually any arrangement of bricks upon the sheet metal panel. The bricks are securely maintained and positioned upon an outer surface of the panel by means of adhesive strips, with a cementitious material such as an acrylic mortar positioned between immediately adjacent bricks. The inner surface of the sheet metal panel may be provided with an insulating layer, with an edge of the panel provided with an angled nail fin arrangement to facilitate mounting of the brick support structure upon an underlying structure. The sheet metal panel provides high tensile strength to withstand various sources of loading such as wind, while the masonry provides a high degree of compressive strength, with the overall panel construction having the strength of a reinforced concrete structure.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A brick support structure for positioning a generally planar array of thin bricks upon a substructure, said support structure comprising:

a thin sheet metal panel mounted to the substructure and including outer and inner surfaces;

a plurality of punched tabs in said sheet metal panel extending from the outer surface thereof, wherein said punched tabs are spaced upon said sheet metal panel so as to be positioned between immediately adjacent upper and lower bricks to provide support for said upper brick when positioned on the outer surface of said sheet metal panel and wherein said punched tabs may be pressed back into said sheet metal panel so as to configure the front surface thereof in accordance with the size and pattern of bricks positioned thereon;

an elongated adhesive member positioned upon the outer surface of said sheet metal panel in alignment with and interposed between adjacent spaced arrays of punched tabs thereon for engaging and securely affixing the bricks to said thin sheet metal panel;

a cementitious material deposited upon the outer surface of said sheet metal panel inbetween the bricks positioned thereon;

an insulating layer positioned intermediate the substructure and said sheet metal panel and affixed to the inner surface thereof; and a generally L-shaped, elongated, horizontally oriented sheet metal portion forming an upper edge of said sheet metal panel disposed immediately above said insulating layer and adapted to receive mounting pins inserted therethrough for securely positioning said brick support structure on said substructure, wherein said sheet metal portion prevents water from flowing down said substructure immediately above said sheet metal panel and onto said insulating layer.

2. The support structure of claim 1 further including an adhesive layer positioned upon the inner surface of said sheet metal panel for securely affixing said insulating layer thereon.

3. The support structure of claim 2 wherein said insulating layer comprises an expanded plastic foam.

4. The support structure of claim 2 wherein said insulating layer comprises a sheet of fiberglass batting.

5. The support structure of claim 1 further including an adhesive layer positioned upon the outer surface of said sheet metal panel for securely affixing said cementitious material thereto.

6. The support structure of claim 1 wherein said elongated adhesive member comprises a mastic strip.

7. The support structure of claim 1 wherein said cementitious material comprises an acrylic mortar.

8. The support structure of claim 1 wherein said tabs are aranged in generally horizontally aligned arrays and wherein each tab is positioned immediately beneath a respective brick positioned upon the outer surface of said sheet metal panel in providing support therefor.

9. The support structure of claim 1 wherein the bricks are irregularly spaced upon the outer surface of said sheet metal panel and wherein some of said tabs are pressed back into said sheet metal panel to permit all of the bricks to be positioned upon and in contact therewith, with the remaining tabs extending from the sheet metal panel and positioned between immediately adjacent bricks.

* * * * *